US008025771B2

(12) United States Patent
Ouchi et al.

(10) Patent No.: US 8,025,771 B2
(45) Date of Patent: Sep. 27, 2011

(54) PAPERMAKING FELT

(75) Inventors: Takashi Ouchi, Bunkyo-ku (JP); Hiroyuki Oda, Bunkyo-ku (JP); Hirofumi Murakami, Bunkyo-ku (JP); Takao Yazaki, Bunkyo-ku (JP); Yoshiaki Ito, Bunkyo-ku (JP); Yuya Takamori, Bunkyo-ku (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 12/884,552

(22) Filed: Sep. 17, 2010

(65) Prior Publication Data

US 2011/0011551 A1 Jan. 20, 2011

Related U.S. Application Data

(63) Continuation of application No. PCT/JP2010/001933, filed on Mar. 18, 2010.

(30) Foreign Application Priority Data

Mar. 19, 2009 (JP) ..... 2009-068458

Jun. 9, 2009 (JP) ..... 2009-138461

(51) Int. Cl.
*D21F 7/08* (2006.01)

(52) U.S. Cl. ..... 162/358.2; 162/900

(58) Field of Classification Search ..... 162/358.1, 162/358.2, 900
See application file for complete search history.

(56) References Cited

U.S. PATENT DOCUMENTS

| | | | | |
|---|---|---|---|---|
| 4,701,368 | A | 10/1987 | Kiuchi et al. | |
| 5,118,557 | A | 6/1992 | Barnewall | |
| 6,531,033 | B1 * | 3/2003 | Kawashima | 162/306 |
| 2004/0200594 | A1 * | 10/2004 | Ouchi et al. | 162/358.2 |
| 2005/0124248 | A1 | 6/2005 | Hyvonen | |
| 2007/0264489 | A1 * | 11/2007 | Sasabe et al. | 428/327 |
| 2010/0018663 | A1 * | 1/2010 | Oouchi | 162/358.2 |
| 2010/0043996 | A1 | 2/2010 | Sawada et al. | |
| 2010/0101744 | A1 | 4/2010 | Sawada et al. | |

FOREIGN PATENT DOCUMENTS

| | | |
|---|---|---|
| EP | 0 346 307 | 12/1989 |
| EP | 1 688 536 | 8/2006 |
| JP | 56-53297 | 5/1981 |
| JP | 01-213481 | 8/1989 |
| JP | 2-127585 | 5/1990 |
| JP | 05-239341 | 9/1993 |
| JP | 10-176030 | 6/1998 |
| JP | 2000-325217 | 11/2000 |
| JP | 2002-309178 | 10/2002 |

(Continued)

OTHER PUBLICATIONS

U.S. Appl. No. 12/823,690, filed Jun. 25, 2010, Yazaki, et al.

(Continued)

*Primary Examiner* — Eric Hug
(74) *Attorney, Agent, or Firm* — Oblon, Spivak, McClelland, Maier & Neustadt, L.L.P.

(57) ABSTRACT

Papermaking felts include a base material and a batt layer provided on one or both sides of the base material. The batt layer includes a water-absorbing resin, and the water-absorbing resin has a coefficient of water absorption of from 1.05 and 10.

14 Claims, 1 Drawing Sheet

FOREIGN PATENT DOCUMENTS

| | | |
|---|---|---|
| JP | 2003-171891 | 6/2003 |
| JP | 2005-146443 | 6/2005 |
| JP | 2005-524002 | 8/2005 |
| JP | 4477091 | 6/2010 |
| WO | WO 2008/053797 | 5/2008 |
| WO | WO 2008-111338 | 9/2008 |

OTHER PUBLICATIONS

Decision to Grant a Patent, Dispatch Date: Mar. 9, 2010 in Japanese Patent Application No. 2009-138461, Drafting Date: Feb. 10, 2010 (with attached English translation).

* cited by examiner

[Fig. 1]
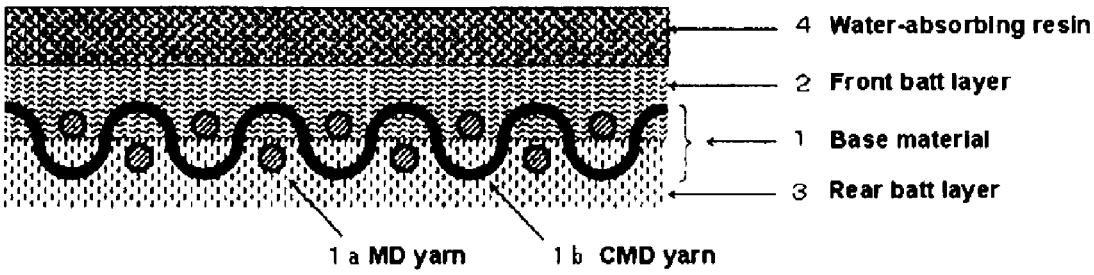
[Fig. 2]
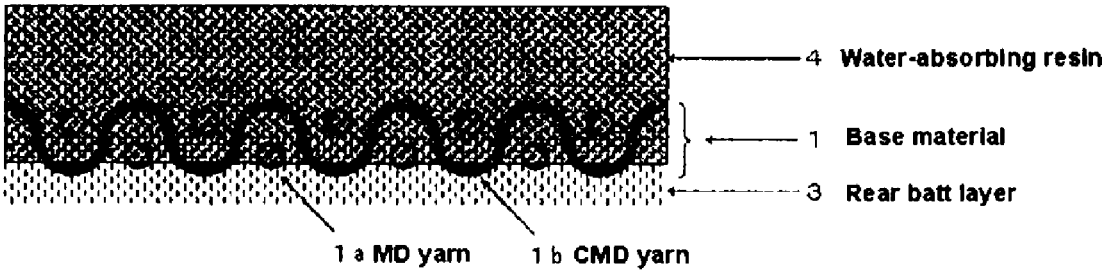

PAPERMAKING FELT

CROSS REFERENCE TO RELATED APPLICATIONS

This application is a continuation of International Application No. PCT/JP2010/001933, filed Mar. 18, 2010, the disclosure of which is incorporated herein by reference in its entirety. This application claims priority to Japanese Patent Application No. 2009-068458, filed Mar. 19, 2009, and Japanese Patent Application No. 2009-138461, filed Jun. 9, 2009, the disclosures of which are incorporated herein by reference in their entireties.

BACKGROUND

The present invention relates to a papermaking felt (hereinafter also called "felt") used for squeezing water from inside a wet paper web, onto which it is stacked, by a pair of rotating rolls or by a roll and a shoe of a papermaking machine. More particularly, the present invention relates to a papermaking felt for improving the capability to squeeze water from the wet paper web during the period including from the initial warming-up period to the top speed operation of papermaking machines at which constant production is possible.

Conventionally, papermaking machines in the papermaking process are generally equipped with a wire part, a press part and a dryer part to dewater wet paper webs. These parts are provided in the direction in which the wet paper web is transferred in the order of: wire part, press part and dryer part. The wet paper web is dewatered and, at the same time, transferred while being passed from one papermaking equipment to the next provided in the wire part, press part and dryer part, respectively, to be finally dried in the dryer part.

Papermaking equipment for dewatering is provided corresponding to each of these parts. The press device provided in the press part comprises a plurality of press devices arranged in series in the direction in which the wet paper web is transported.

Each press device comprises an endless felt or an open-ended felt that has been made into an endless felt by connecting it in the papermaking machine and, as a press, a pair of rolls (i.e., a roll press) or a roll and a shoe (i.e., a shoe press), which are provided so as to face each other and pinch therebetween one part of the felt, respectively, from above and below; wherein pressure is applied on a wet paper web, which is transported by a felt traveling at substantially a same speed and in the same direction, together with the felt by one roll and the other roll or between the roll and the shoe, whereby the moisture in a wet paper web is squeezed out and is being continuously absorbed by the felt.

Moreover, among these types of papermaking machines there are some that have a roll press mechanism, provided in the press device of the press part, for pressing while pinching, between one roll and the other roll, one part of the felt(s) holding the wet paper web (therebetween), while others have a shoe press mechanism, provided in the press device of the press part, for pressing while pinching, between the roll and the shoe, one part of the felt(s) holding the wet paper web (therebetween).

The felt is made from a base material and (a) batt layer(s); the batt layer(s) is (are) provided both on the wet paper web carrying-side and on the press roll-side of the base material or only on the wet paper web carrying side. The batt layer is made by intertwiningly integrating batt fibers with the base material by needle punching. The felt basically has the functions of squeezing water from the wet paper web (water squeezing capability), of increasing the smoothness of the wet paper web and of transferring the wet paper web.

Above all, what is considered to be important in a felt is the function of dewatering the wet paper web, the ability to maintain compressibility and water permeability, resulting from a suitable free space volume in the felt, for discharging water that has moved from the wet paper web to the felt due to passing the pressure between the pair of rolls or the roll and the shoe, to the outside of the felt system.

The suitable free space volume is the free space volume during constant speed operation of a papermaking machine. From the viewpoint of productivity, it is important that the operating speed stabilizes rapidly; the time until this happens is called the initial warming-up period. The initial warming-up period differs according to the operating conditions of the papermaking machine; however, in general one to two days, at most five days, are required. In particular, with the no-draw straightthrough type of wet paper transfer method, of which the Tandem-Nipco Flex papermaking machine is a representative example, it is important to shorten the initial warming-up period and to increase operating speed.

Various conventional felts have been developed from this point of view. For example, after a felt has been prepared, a commonly known technique is to apply pressure to make the felt thinner during the following processes and to increase the density. There are also cases in which the felt is brought into contact with a roll that has been heated by a heating medium in order to increase the effect of the pressing. The operating mechanism is to reduce the free space volume in the felt and to facilitate the transfer of the pressing force received in the press part to the wet paper web.

In Patent document 1 (JP-T-2005-524002), a compacting method is described in which the felt surface is polished after it has been treated with a polymer substance. A felt of this structure is compacted from the beginning; therefore, it leads to the shortening of the initial warming-up period of the papermaking machine.

Nevertheless, even though a papermaking felt using the polyurethane, polycarbonate urethane, polyacrylate, acryl resin, epoxy resin, phenol resin or mixed polymers thereof according to Patent document 1 can be compacted due to the adhesive force and the coagulating force of the polymers, stiffness is given to the felt as a whole. When the stiffness becomes too great, the compression/recovery behavior under the press is suppressed and sufficient wet paper web water squeezing performance cannot be obtained; further, when the felt is placed in a papermaking machine, together with the difficult operation of manually inserting the felt into the narrow space between the rolls, there is also a problem with regard to the easiness of loading the felt.

In Patent document 2 (JP-A-02-127585), a manufacturing method for coating a foam resin onto a felt surface and for drying and curing the same is described. In a felt of this structure, the felt surface, which due to the foam resin has a porous contact region, removes the water from the wet paper web.

Nevertheless, in the felt described in Patent document 2, the porous part can receive the moisture that is squeezed from the wet paper web when it is new; however, under the direct impact of the repeated pressure from the press roll, the felt, including the porous part, is gradually compacted. There is the problem that the water squeezing capability deteriorates because, when the foam resin layer is compacted, the water permeability decreases, and when it accumulates dirt from the wet paper web, it becomes impossible to receive the moisture from the wet paper web.

Patent document 3 (JP-A-2005-146443), which employs the same type of foam resin, proposes a production method, wherein a layer (wall structure) is provided by a foam gel inside the wet paper web contact layer on the felt base material. In a felt of this structure, which has good pressure dispersion, base fabric marking is prevented and the surface smoothness of the wet paper web is improved.

Nevertheless, in the felt described in Patent document 3, even though the gel foam layer is not in direct contact with the press roll, there is the same problem as in Patent document 2.

With the felt described in Patent document 4 (JP-A-56-53297), it can be expected that the initial warming-up period is shortened due to the hydrophilic properties of the sodium acrylate-acrylamide copolymer fibers.

Nevertheless, with the felt described in Patent document 4, there is the problem that the ability to maintain the water squeezing capability deteriorates, because the durability of the sodium acrylate-acrylamide copolymer fibers is low. There is further the problem that the fibers of low durability are shed from the felt and get attached to the paper, which is a hindrance during printing.

SUMMARY

With these types of conventional felts, the initial warming-up period is short; however, there is the problem that, since the free space inside a felt which has been made thin from the beginning is reduced, the felt is crushed by the repeated pressure received during use and rapidly arrives at the limit of the thickness at which it can be used; thus the time during which the wet paper web can be sufficiently squeezed is short.

Moreover, when the press force is increased during the production process in order to reduce the free space even further, the fibers constituting the felt hit against each other and it has to be feared that fibers are lost because pressure marks remain at the points the fibers intermingle and strength deteriorates.

An object of the present invention is to solve the reciprocal problems of shortening the initial warming-up period and of ensuring the constant operation period.

In particular, it is the object of the present invention to provide a papermaking felt, wherein the basic functions are well balanced, which does not have any wet paper web transfer deficiencies due to meandering, or the like, wherein, free space of a felt, in which the effect of the press pressure and the hydraulic pressure is scarcely conveyed to the wet paper web from which water is squeezed, is set to the suitable amount for the initial warming-up from the start so that the initial warming-up period is shortened, and wherein water squeezing does not deteriorate due to premature decline of water permeability and due to the inability to maintain compressibility by excessive compaction and accumulation of dirt.

The present invention was made by discovering that, by including a water-absorbing resin in a papermaking felt, it is possible, both, to appropriately ensure a free space volume in a felt after water is absorbed and to maintain compressibility; thus the invention was completed. In order to solve the above-mentioned problems, the present invention is characterized in that a water-absorbing resin is included in a batt layer of a papermaking felt made from a base material and at least a wet paper web stacking side batt layer. Specifically, the present invention is based on the technology described hereinafter.

(1) A papermaking felt wherein a batt layer is provided on one side, or on both sides, of a base material, and wherein a water-absorbing resin with a coefficient of water absorption between 1.05 and 10 is included in the batt layer of said felt.

(2) A papermaking felt according to (1); wherein said water-absorbing resin comprises a urethane structure obtained by reacting (a) polyisocyanate compound(s) selected from the compounds of component [a] and (a) polyol compound(s) selected from the compounds of component [b]:

[a] one or more polyisocyanate compound(s) selected from 1,4-tetramethylene diisocyanate, 1,6-hexamethylene diisocyanate, 1,12-dodecamethylene diisocyanate, 1-isocyanate-3-isocyanatemethyl-3,5,5-trimethylcyclohexane(isophorone diisocyanate), bis-(4-isocyanatocyclohexane)methane(hydrogenated MDI), 4,4'-methylene bis(phenyl isocyanate), tolylene-diisocyanate, xylylene-diisocyanate, tetramethylxylylene-diisocyanate, 1,5-naphthalene diisocyanate, p-phenylene-diisocyanate, cyclohexane diisocyanate, 2- and 4-isocyanate cyclohexyl-2'-isocyanate cyclohexyl methane, bis-(isocyanate methyl)-cyclohexane, and bis-(4-isocyanate-3-methyl cyclohexyl)methane

[b] one or more polyol compound(s) selected from one or more polyether polyol(s) selected from polyethylene glycol, polypropylene glycol, polybutylene glycol, polypentylene glycol, polyhexylene glycol, glycerin, trimethylolethane, trimethylolpropane, hexanetriol, and pentaerythritol, and/or polyester polyols of one or more compound(s) selected from oxalic acid, malonic acid, succinic acid, glutaric acid, adipic acid, azelaic acid, sebacic acid, phthalic acid, isophthalic acid, terephthalic acid, ricinoleic acid, and ϵ-caprolactone, and one or more compound(s) selected from ethylene glycol, propanediol, butanediol, pentanediol, hexanediol, neopentyl glycol, diethylene glycol, 3-methyl-1,5-propanediol, glycerin, trimethylolethane, trimethylolpropane, hexanetriol, and pentaerythritol, and/or one or more polycarbonate polyol(s) selected from C6-homo-carbonate diol, C5/C6 copolymerized polycarbonate diol, and C4/C6 copolymerized polycarbonate diol, and/or acrylic polyol.

(3) A papermaking felt according to (2); wherein the water-absorbing resin comprises one or more structure(s) obtained by reacting the polyol compounds of said component [b] with compounds selected from carboxylic acid sodium salt, carboxylic acid potassium salt, sulfonic acid sodium salt, sulfonic acid potassium salt, and quaternary halogenated ammonium salt.

(4) A papermaking felt according to (1); wherein the water-absorbing resin comprises a component selected from the following compounds: one or more compound(s) selected from chain or cyclic silicon compounds having one or more functional group(s) selected from hydrogen, alkyl group, aryl group, alkoxy group, hydroxyl group, polyether group, polyglycerol group, amino group, epoxy group, carboxyl group, amide group, methacrylate group, mercapto group, and N-alkylpyrrolidone group at the side chain and/or the terminal thereof; compounds comprising a structure obtained by addition reaction on starch of one or more compound(s) selected from acrylonitrile, acrylic acid, acrylamide, methyl methacrylate, vinyl acetate, vinyl sulfonic acid, dimethylaminoethyl methacrylate, sodium monochloroacetate, sodium polyacrylate, epichlorohydrin, and styrene sulfonic acid; compounds comprising a structure of self-cross-linked starch; compounds comprising a structure obtained by addition reaction on carboxymethyl cellulose of one or more compound(s) selected from acrylonitrile, sodium monochloroacetate, sodium polyacrylate, epichlorohydrin, and styrene sulfonic acid; compounds comprising a structure of self-cross-linked carboxymethyl cellulose; compounds comprising a structure wherein hyaluronic acid and/or agarose are/is cross-linked with boron and/or aluminum ions; compounds comprising a structure of self-cross-linked hyaluronic acid and/or agarose; compounds comprising a structure wherein a compound selected from acrylic acid and sodium polyacrylate is graft-polymerized on polyvinyl alcohol; compounds comprising a structure of self-cross-linked polyvinyl alcohol; acrylic copolymer compounds comprising a structure wherein one or more compound(s) selected from acrylic acid, sodium acrylate, methyl methacrylate, acrylonitrile, vinyl alcohol, isopropylacrylamide, methylene-bis-acrylamide is (are) copolymerized; compounds comprising a structure wherein compounds selected from acrylic acid and sodium acrylate are graft-polymerized on polyurethane; methylene-bis-acrylamide copolymer compounds comprising a structure in which a compound selected from methacrylic acid and isopropylacrylamide is copolymerized; hydroxy methacrylate copolymer compounds comprising a structure wherein a compound selected from ethylene glycol dimethacrylate and 2,3-dihydroxypropyl methacrylate is copolymerized; nanocomposite hydrogel wherein a compound selected from a compound comprising a structure of self-cross-linked hydroxyl methacrylate copolymer compounds and isopropylacrylamide and dimethylacrylamide is adjusted with hectorite.

(5) A papermaking felt according to any one of (1) to (4); wherein one or more crosslinking agent [c] component(s) is (are) further reacted by cross-linking with the water-absorbing resin.

(6) A papermaking felt according to (5); wherein the cross-linking agent [c] component is one or more compound(s) selected from ethylene glycol, propanediol, butanediol, pentanediol, hexanediol, polyethylene glycol, polypropylene glycol, polybutylene glycol, bisphenol A, trimethylolethane, trimethylolpropane, propanetriol (glycerin), butanetriol, pentanetriol, hexanetriol, cyclopentanetriol, cyclohexanetriol, erythritol, pentaerythritol, diglycerin, sorbitol, mannitol, sucrose, triethanolamine, ethanolamine, ammonia, ethylenediamine, propanediamine, butanediamine, hexanediamine, diethyl toluenediamine, dimethyl-thio-toluenediamine, 4,4'-bis(2-chloroaniline), 4,4'-bis(sec-butylamino)-diphenylmethane, N,N'-dialkyldiamino-diphenylmethane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylene-bis(4-aminobenzoate), poly (tetramethylene oxide)-di-p-aminobenzoate, phenylenediamine, isophorone diamine, 4,4'-methylene bis (2-methylcyclohexane-1-amine), 4,4'-methylene bis(cyclohexane amine), bis(aminomethyl)cyclohexane, xylene diamine, iminobis-propylamine, bis(hexanemethylene)triamine, triethylene tetramine, tetraethylene pentamine, pentaethylenehexamine, dipropylene triamine, aminoethylethanolamine, piperazine, tri(methylamino)hexane, melamine, a polycondensate of melamine and formaldehyde, polyethylene glycol mono(meta) acrylate, polyethylene glycol di(meta) acrylate, Nmethylol (meta) acrylamide, glycidyl (meta) acrylate, N,N-methylene bis(meta) acrylamide, ethylene glycol diglycidyl ether, diethylene glycol diglycidyl ether, glycerin diglycidyl ether, glycerin triglycidyl ether, butanediol diglycidyl ether, hexanediol diglycidyl ether, cyclohexane dimethanol diglycidyl ether, trimethylolpropane diglycidyl ether, trimethylolpropane triglycidyl ether, polyethylene glycol polyglycidyl ether, and bis phenol A diglycidyl ether.

(7) A papermaking felt according to any one of (1) to (6); wherein the dry resin weight of the water-absorbing resin is 0.5 to 30 wt. % of the felt weight before including the resin.

(8) A papermaking felt according to any one of (1) to (7); wherein the water-absorbing resin comprises one or more filler(s) such as titanium oxide, kaolin, clay, talc, or the like.

In the papermaking felt according to the present invention, due to the water-absorbing action of the water-absorbing resin, the free space volume is reduced in a felt in which the effect of the press pressure and the hydraulic pressure is scarcely conveyed to the wet paper web, and the initial warming-up period is shortened. Moreover, since compressibility is maintained due to the flexibility and durability of the resin that is swollen by water, the water draining capability can be maintained together with an improvement of the ability to maintain elasticity, as will be shown in the Examples.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a view showing a felt according to the present invention in which the water-absorbing resin stays in the front-side (wet paper web contact side) batt layer.

FIG. 2 is a view showing a felt according to the present invention in which the water-absorbing resin reaches from the front-side batt layer to the rear-side batt layer.

DETAILED DESCRIPTION OF EXEMPLARY EMBODIMENTS

The drawings show one example of a papermaking felt according to the present invention. The present invention is, however, not limited to the specific example shown in the drawings. The example of a papermaking felt shown in the drawings comprises a base material 1, a batt layer 2, and a rear batt layer 3 disposed on the press roll-side of the base material; in FIG. 1, the water-absorbing resin 4 stays in the wet paper web carrying-side batt layer 2; in FIG. 2, the water-absorbing resin 4 reaches the press roll-side batt layer 3. The wet paper web-side batt layer 2 includes batt fiber and water-absorbing resin 4 which fill a part of the space formed by the batt fiber. The machine direction yarn (MD yarn) 1*a* and the cross machine direction yarn (CMD yarn) 1*b* are also shown in FIGS. 1 and 2.

In general, a papermaking felt is made by batt layers sandwiching a base material. The base material is generally a fabric woven by a weaving machine, or the like, from a machine direction yarn and a cross machine direction yarn. Examples of materials used for the machine direction and cross machine direction yarns of the base material and for the batt include polyesters (polyethylene terephthalate, polybutylene terephthalate, or the like), polyamides (nylon 6, nylon 66, nylon 610, nylon 612, or the like), polyphenylene sulfide, polyvinylidene fluoride, polypropylene, aramid, polyetheresterketone, polytetrafluoroethylene, polyethylene, polyvinyl chloride, cotton, wool, metal, or the like.

<Types of Water-Absorbing Resin>

As water-absorbing resin, one or more water-absorbing resin(s) of natural polymers or synthetic polymers with a coefficient of water absorption between 1.05 and 10 can be used.

Of the natural polymer type water-absorbing resins, examples of starch based include water-absorbing resins obtained by addition reaction of (a) monomer(s) on starch or ionizing radiation irradiation induced cross-linking in starch; wherein the monomers may be generally known monomers such as acrylonitrile, acrylic acid, acrylamide, methyl methacrylate, vinyl acetate, vinyl sulfonic acid, dimethylaminoethyl methacrylate, sodium monochloroacetate, sodium polyacrylate, epichlorohydrin, styrene sulfonic acid, or the like.

Examples of cellulose water-absorbing resins include water-absorbing resins obtained by addition reaction of (a) monomer(s) on CMC or ionizing radiation irradiation induced cross-linking in CMC; examples of monomers include acrylonitrile, sodium monochloroacetate, sodium polyacrylate, epichlorohydrin, styrene sulfonic acid, or the like.

Examples of polysaccharide based water-absorbing resins include water-absorbing resins obtained by boron or aluminum, or the like, multicharged ion mediated crosslinking or ionizing radiation irradiation induced cross-linking of hyaluronic acid or agarose.

Of the synthetic polymer type water-absorbing resins, examples of PVA based include water-absorbing resins obtained by addition reaction of (a) monomer(s) thereon or ionizing radiation irradiation induced cross-linking thereof. Examples of monomers include acrylic acid, sodium polyacrylate, or the like.

Examples of acrylic acid include acrylamide copolymers (examples of copolymer monomers include sodium acrylate, acrylic acid, vinyl alcohol, isopropylacrylamide, methylene bis acrylamide, or the like), acrylic acid copolymers (examples of copolymer monomers include sodium acrylate, acrylonitrile, or the like), methylene bis acrylamide copolymers (examples of copolymer monomers include methacrylic acid, isopropylacrylamide, or the like), or sodium polyacrylate cross-linked by ionizing radiation irradiation. Apart from these, NC gels in which acrylamide derivative (NIPA, DMAA) monomers are adjusted with an inorganic component (hectorite) can also be used.

Examples of urethane water-absorbing resins include denaturated polyols, wherein hydrophilic polyol is reacted with polyisocyanate, in which the hydrophilic polyol is obtained by addition polymerization on polyhydric alcohol of ethylene oxide on its own or with ethylene oxide and propylene oxide, and blended polyols, wherein a water-absorbing resin of starch, PVA, or the like, is blended in polyol and reacted with isocyanate, or the like. Among these, a water-absorbing resin, wherein hydrophilic polyol is reacted with polyisocyanate, in which the hydrophilic polyol is obtained by addition polymerization on polyhydric alcohol of ethylene oxide (EO) and propylene oxide (PO), is preferred.

Examples of the above-mentioned polyisocyanates include aromatic, aliphatic or alicyclic polyisocyanate, for example, tolylene diisocyanate (TDI), 4,4'-diphenylmethane diisocyanate (MDI), 2,4-diphenylmethane diisocyanate, naphthalene diisocyanate (NDI), hexamethylene diisocyanate, and mixtures thereof.

Examples of the above-mentioned polyols include aromatic hydrophilic polyols obtained by addition polymerization on aromatic polyhydric alcohol of EO or PO. Preferred aromatic polyhydric alcohols are 4,4'-dihydroxy phenyl sulfone, resorcine, 1,4-bis hydroxyethoxy benzene. Among these, polyether polyols obtained by reacting polyether polyols in which the amount of the oxyethylene groups is between 40 and 100% of the weight in the polyoxy alkylene, and polyether polyol with a molecular weight of 1000 or less and in which the amount of oxyethylene groups is between 0 and 30% of the weight in the polyoxy alkylene are preferred.

<The Form of the Water-Absorbing Resins>

The shape of the water-absorbing resins included in the batt layer of the papermaking felt is not particularly limited, it may be in the form of particles or it may be in the form of a dispersed film. However, a water-absorbing resin that, after water absorption, forms a continuous film layer like a sheet hinders water permeability is not preferred.

<Coefficient of Water Absorption>

The coefficient of water absorption is measured by the following method.

1. The weight of a specimen (water-absorbing resin), measured up to an accuracy of 0.01 g after drying for one hour at 105 degrees Celsius, is defined as $M_1$.

2. Suitable amounts of the specimen (for example 100 g) are filled into bags of nonwoven fabric, one nonwoven fabric bag at a time is completely immersed in an immersion liquid obtained from a sufficient amount of pure water of 20 degrees Celsius+−2 degrees Celsius.

3. The nonwoven fabric bags with the specimen are taken out of the immersion liquid at intervals of one hour and are introduced into a rotary dewatering machine (a Sheet Former manufactured by Kumagai Riki Kogyo Co., Ltd.).

4. The rotational speed of the Sheet Former is set so as to obtain a prescribed speed of 1500 m/min., and dewatering is performed for a prescribed time (5 minutes) after the speed reaches the set value (after 12 seconds).

5. After dewatering has continued for 5 minutes, brakes are applied to stop the centrifugal dewatering. The total weight of the dewatered nonwoven fabric bag and the specimen are measured up to an accuracy of 0.01 g.

6. Thereafter, steps 3. to 5. are repeated, and the total weight of the specimen and the nonwoven fabric bag at the time there is no more weight increase is defined as $M_2$.

7. The nonwoven fabric bag is immersed in the pure water on its own, and the weight of the nonwoven fabric bag measured according to steps 3. to 5. above is defined as $S_1$; the value of the coefficient of water absorption is obtained according to the formula: coefficient of water absorption= $(M_2-S_1)/M_1$.

The coefficient of water absorption is preferably between 1.05 and 10.

The location in which these water-absorbing resins are included in the papermaking felt is not particularly limited; however, they are preferably included in a region from the wet paper web carrying-side batt layer to the base material. Specifically, the water-absorbing resins may be included only in the wet paper web carrying-side batt layer 2, in the region from the wet paper web carrying-side batt layer 2 to the press roll-side batt layer 3, in the region from the wet paper web carrying-side batt layer 2 to the base material 1, or in the region from the press roll-side batt layer 3 to the base material 1.

The means for including the water-absorbing resin in the felt include such techniques as coating-impregnating, spray coating, blade coating, or the like, of the felt with an aqueous dispersion liquid in which water-absorbing resin particles have been dispersed in an aqueous solution.

A cross-linking agent may be used as needed for causing the water-absorbing resin to hold firmly to the felt; the cross-linking agent is coated in a dispersed form in the above-mentioned aqueous dispersion liquid, and thereafter cross-linking reaction is performed by heating or by electron beam radiation. Examples of cross-linking agents include, for example, polyethylene glycol mono(meta) acrylate, N-methylol(meta) acrylamide, glycidyl(meta) acrylate, polyethylene glycol di(meta) acrylate, N,N-methylene bis(meta) acrylamide, or the like, and diglycidyl ether or polyglycidyl ether of ethylene glycol diglycidyl ether, polyethylene glycol diglycidyl ether, fatty polyhydric alcohol, or the like, and mixtures thereof. Moreover, one or more types of cross-linking agent(s) may be used.

The free space volume, which can be obtained in a papermaking felt apart from the fibers, is preferably maintained at a fixed volume from the initial warming-up period to the transition of the operating speed to the top speed region, at which constant production is possible, until the final period of operation is reached. Therefore, the losing speed of the water absorbed resin from the felt may be controlled in the view of the operating conditions and the amount of water removed from the wet paper web.

The used amount of the cross-linking agent is determined by the molar equivalent of the reactive groups (isocyanate groups in the case of urethane-based water-absorbing agents) of the water-absorbing agent and the molar equivalent of the reactive groups (active hydrogen groups) of the cross-linking agent. The durability after the cross-linking is controlled by adjusting a suitable equivalent ratio (—NCO/—H). Specifically, an equivalent ratio of 0.7 to 1.5 is preferred.

According to the present invention, a papermaking press felt can be obtained which can improve the water squeezing capability from a wet paper web during the entire period of use including the initial warming-up period and until the top speed of a papermaking machine is reached at which constant production is possible, which can be installed in a papermaking machine with the same load as used for conventional felts, and which is of practical utility in the papermaking industry.

Other features of the invention will become apparent in the course of the following descriptions of exemplary embodiments which are given for illustration of the invention and are not intended to be limiting thereof.

EXAMPLES

Hereinafter, the present invention will be described by the Examples and the Comparative Examples. The present invention is, however, not limited to these Examples.

Examples 1 to 6, Comparative Examples 1 and 2

The papermaking felts used in the Examples and Comparative Examples had the following basic configuration:

Base material: (twine of nylon monofilaments, single weave): basis weight 750 g/$m_2$ Batt fiber (nylon 6 staple fibers of 17 dcTex)

Wet paper web carrying-side of the base material: basis weight 500 g/$m_2$

Press roll-side of the base material: basis weight 250 g/$m_2$

After forming a felt by stacking and intertwiningly integrating the rear-side batt fibers, the front-side batt fibers and the base material by needling (Comparative Example 1), the water-absorbing resin compositions shown in Table 1 were applied from the front surface batt side, dried for 60 minutes at 105 degrees Celsius and, thereafter, cured (thermal hardening) for 30 minutes at 140 degrees Celsius.

Furthermore, the weight of the filler is used in the ratio of 8 wt. parts per 100 wt. parts of water-absorbing resin. The coefficient of water absorption of the water-absorbing resin used for the papermaking felts obtained and the amount of water-absorbing resin attached to the felt in the dried state after curing are shown in Table 1. The percentage amount of dried water-absorbing resin attached to the felt represents the ratio of the weight (dry weight) of water-absorbing resin attached to the felt per 100 wt. parts of felt material before the water-absorbing resin is attached.

TABLE 1

Condition of the Examples and Comparative Examples

| | Water-absorbing resin | Cross-linking agent | Filler | Water-absorption coefficient | Attached amount of dried water-absorbing resin |
|---|---|---|---|---|---|
| Example 1 | Nonionic polyether polyurethane (HYDRAN product of DIC) | Trimethylolpropane (product of Mitsubishi Gas Chemical) | — | 1.1 | 8 wt. % |
| Example 2 | Anionic polyether polyurethane (ELASTRON product of Daiichi Kogyo Seiyaku) | Polyethylene glycol (product of Daiichi Kogyo Seiyaku) | — | 3.0 | 2 wt. % |
| Example 3 | Anionic polyether polyurethane (ELASTRON product of Daiichi Kogyo Seiyaku) | Bis phenol A diglycidyl ether (product of ADEKA) | Kaolin (product of IMERYS) | 3.0 | 8 wt. % |
| Example 4 | Cationic polyether polyurethane (PERMARIN product of Sanyo Chemical Industries) | Melamine-formamide (product of Monsanto) | — | 8.0 | 8 wt. % |
| Example 5 | Anionic polyester polyurethane (ADEKABONTIGHTER product of ADEKA) | — | — | 3.0 | 28 wt. % |
| Example 6 | Cross-linked polyacrylic acid (Aqua Keep product of Sumitomo Seika Chemicals) | N-methylol(meta) acrylamide (product of Soken Chemical) | — | 3.0 | 8 wt. % |
| Comparative Example 1 | — | — | | — | — |
| Comparative | Anionic polycarbonate type | Trimethylolpropane | | 1.0 | 8 wt. % |

TABLE 1-continued

| Condition of the Examples and Comparative Examples | | | | | |
|---|---|---|---|---|---|
| | Water-absorbing resin | Cross-linking agent | Filler | Water-absorption coefficient | Attached amount of dried water-absorbing resin |
| Example 2 | polyurethane (Bayhydrol product of Nippon Bayer) | (Product of Mitsubishi Gas Chemical) | | | |

The papermaking felts that were obtained in the Examples 1 to 6 and the Comparative Examples 1 and 2 were tested under the traveling test conditions described hereinafter for 100 hours at a traveling speed of 1,000 m/min. and under a roll pressure of 100 kN/m; the water squeezing capability, the ability to maintain elasticity and the ability to maintain water permeability were evaluated.

Water squeezing test; high speed press tester

Water squeezing test conditions: pressure 100 kN/m, papermaking speed 1000 m/min.

Wet paper web moisture content before pressing; 70%

Wet paper web moisture content before pressing=(wet paper web weight before pressing−dry paper weight)/wet paper web weight before pressing×100

Compression ratio (%)=$(T_0-T_1/T_0\times100$

Thickness maintaining ratio (%)=$(T_2/T_0)\times100$

Water percolation test; water percolation tester

Water percolation value; 20 MPa pressure; a metal plate having been disposed on one side of a 120 mm f felt sample, the time required for 5 liters of water to pass at a hydraulic pressure of 3 MPa from the side without metal plate.

The shorter this time, the better is the water permeability.

Water percolation maintaining ratio (%)=water percolation value before the traveling test/water percolation value after the traveling test×100.

The results thereof are shown in Table 2.

TABLE 2

| | Evaluated items | | | | | | | | |
|---|---|---|---|---|---|---|---|---|---|
| | Physical properties during the traveling test | | | | | | Physical properties before/after the traveling test | | |
| | Water squeezing capability | | Elasticity maintaining properties | | | | Water permeability maintaining properties | | |
| | Wet paper web moisture content after pressing (%) | | Compression ratio of the pressing (%) | | Before/after pressing thickness maintaining ratio (%) | | Water percolation value (seconds) | | Water percolation maintaining ratio (%) |
| | after 10 min. | after 100 h | after 10 min. | after 100 h | after 10 min. | after 100 h | before travel. test | after travel test | |
| Example 1 | 52 | 50 | 30.8 | 27.8 | 84.0 | 86.3 | 43 | 84 | 51.2 |
| Example 2 | 53 | 51 | 30.5 | 27.0 | 83.3 | 85.9 | 40 | 86 | 46.5 |
| Example 3 | 48 | 47 | 31.6 | 29.8 | 85.6 | 87.9 | 48 | 95 | 50.5 |
| Example 4 | 46 | 49 | 31.8 | 28.2 | 87.0 | 87.4 | 53 | 90 | 58.9 |
| Example 5 | 49 | 50 | 31.5 | 27.1 | 85.2 | 87.3 | 55 | 91 | 60.4 |
| Example 6 | 49 | 48 | 31.2 | 29.3 | 85.3 | 87.4 | 48 | 96 | 50.0 |
| Comparative Example 1 | 56 | 53 | 29.7 | 22.1 | 81.5 | 84.3 | 35 | 81 | 43.2 |
| Comparative Example 2 | 53 | 51 | 30.2 | 23.2 | 83.0 | 85.7 | 42 | 88 | 47.7 |

Wet paper web moisture content after pressing=(wet paper web weight after pressing−dry paper weight)/wet paper web weight after pressing×100

The lower the wet paper web moisture content after pressing, the better is the water squeezing capability of the papermaking felt; in the papermaking industry, even if the difference of the wet paper web moisture content after pressing is only 1%, there is a significant impact on the amount of thermal energy required in the paper drying process after pressing.

Compression test; high speed press tester

Felt thickness before pressing; $T_0$

Felt thickness during pressing; $T_1$ (100 kN/m)

Felt thickness after pressing; $T_2$

Table 2 shows that the lower the wet paper web moisture content after pressing, the better is the water squeezing capability, and that the higher the compression ratio of the pressing and the before/after pressing thickness maintaining ratio, the better are the elasticity maintaining properties.

In the papermaking felts of Examples 1 to 6, it can be seen that the water squeezing capability and the elasticity maintaining ratio is improved due to the swelling of the water-absorbing resin in the felts.

Moreover, the papermaking felts of Examples 1 to 6 exhibit high values of water percolation maintaining ratio; the reason for this is that, due to the water-absorbing resin, the excessive free space at the time the felt is new is closed, and due to the gradual loss of resins occurring together with use, the felts possess a suitable water permeability from the initial warming-up to the final period of operation.

Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

The invention claimed is:

1. A papermaking felt, comprising:

a base material; and a batt layer provided on one or both sides of the base material;

wherein:

the batt layer comprises a water-absorbing resin; and the water-absorbing resin has a coefficient of water absorption of from 1.05 to 10.

2. The papermaking felt according to claim 1, wherein:

the water-absorbing resin is obtained by reacting at least one cross-linking agent (c) with a polyurethane, which comprises a urethane structure obtained by reacting at least one polyisocyanate compound (a) with at least one polyol compound (b);

the at least one polyisocyanate compound (a) comprises at least one member selected from the group consisting of 1,4-tetramethylene diisocyanate, 1,6-hexamethylene diisocyanate, 1,12-dodecamethylene diisocyanate, 1-isocyanate-3-isocyanatemethyl-3,5,5-trimethylcyclohexane (isophorone diisocyanate), bis-(4-isocyanatocyclohexane)methane (hydrogenerated MDI), 4,4'-methylene bis(phenyl isocyanate), tolylenediisocyanate, xylylene-diisocyanate, tetramethylxylylene-diisocyanate, 1,5-naphthalene diisocyanate, p-phenylene-diisocyanate, cyclohexane diisocyanate, 2,4-isocyanate cyclohexyl-2'-isocyanate cyclohexyl methane, bis-(isocyanate methyl)-cyclohexane, and bis-(4-isocyanate-3-methyl cyclohexyl)methane; and the at least one polyol compound (b) comprises at least one member selected from the group consisting of:

polyether polyols selected from polyethylene glycol, polypropylene glycol, polybutylene glycol, polypentylene glycol, polyhexylene glycol, glycerin, trimethylolethane, trimethylolpropane, hexanetriol, and pentaerythritol;

polyester polyols obtained by reacting at least one carboxylic acid with at least one polyol compound (d), wherein:

the at least one carboxylic acid comprises at least one member selected from the group consisting of oxalic acid, malonic acid, succinic acid, glutaric acid, adipic acid, azelaic acid, sebacic acid, phthalic acid, isophthalic acid, terephthalic acid, ricinoleic acid, and ϵ-caprolactone; and the at least one polyol compound (d) comprises at least one member selected from the group consisting of ethylene glycol, propanediol, butanediol, pentanediol, hexanediol, neopentyl glycol, diethylene glycol, 3-methyl-1,5-propanediol, glycerin, trimethylolethane, trimethylolpropane, hexanetriol, and pentaerythritol;

polycarbonate polyols selected from C6-homo-carbonate diol, C5/C6 copolymerized polycarbonate diol, C4/C6 copolymerized polycarbonate diol; and acrylic polyols.

3. The papermaking felt according to claim 2, wherein the at least one cross-linking agent (c) comprises at least one member selected from the group consisting of carboxylic acid sodium salts, carboxylic acid potassium salts, sulfonic acid sodium salts, sulfonic acid potassium salts, and quaternary halogenated ammonium salts.

4. The papermaking felt according to claim 1, wherein the water-absorbing resin comprises at least one component selected from the group consisting of:

compounds selected from chain or cyclic silicon compounds having at least one functional group as a side chain and/or terminal selected from hydrogen, alkyl groups, aryl groups, alkoxy groups, hydroxyl groups, polyether groups, polyglycerol groups, amino groups, epoxy groups, carboxyl groups, amide groups, methacrylate groups, mercapto groups, and N-alkylpyrrolidone groups;

compounds comprising a structure obtained by an addition reaction to starch of at least one compound selected from acrylonitrile, acrylic acid, acrylamide, methyl methacrylate, vinyl acetate, vinyl sulfonic acid, dimethylaminoethyl methacrylate, sodium monochloroacetate, sodium polyacrylate, epichlorohydrin, and styrene sulfonic acid;

compounds comprising a structure of a self-cross-linked starch;

compounds comprising a structure obtained by an addition reaction to carboxymethyl cellulose of at least one compound selected from acrylonitrile, sodium monochloroacetate, sodium polyacrylate, epichlorohydrin, and styrene sulfonic acid;

compounds comprising a structure of a self-cross-linked carboxymethyl cellulose;

compounds comprising a structure including hyaluronic acid and/or agarose cross-linked with boron and/or aluminum ions;

compounds comprising a structure of self-cross-linked hyaluronic acid and/or agarose;

compounds comprising a structure including acrylic acid and/or sodium polyacrylate graft-polymerized with polyvinyl alcohol;

compounds comprising a structure of self-cross-linked polyvinyl alcohol;

acrylic copolymer compounds copolymerized with at least one of acrylic acid, sodium acrylate, methyl methacrylate, acrylonitrile, vinyl alcohol, isopropylacrylamide, and methylene-bis-acrylamide;

compounds comprising a structure including acrylic acid and/or sodium acrylate graft-polymerized with polyurethane;

methylenebis-acrylamide copolymer compounds comprising copolymerized with at least one of methacrylic acid and isopropylacrylamide;

hydroxy methacrylate copolymer compounds copolymerized with at least one of ethylene glycol dimethacrylate and 2,3-dihydroxypropyl methacrylate; and nanocomposite hydrogels comprising at least one compound selected from a compound comprising a structure of self-cross-linked hydroxyl methacrylate copolymer compounds, isopropylacrylamide and dimethylacrylamide, adjusted with hectorite.

5. The papermaking felt according to claim 2, wherein the at least one cross-linking agent (c) comprises at least one member selected from the group consisting of ethylene glycol, propanediol, butanediol, pentanediol, hexanediol, polyethylene glycol, polypropylene glycol, polybutylene glycol, bisphenol A, trimethylolethane, trimethylolpropane, propanetriol (glycerin), butanetriol, pentanetriol, hexanetriol, cyclopentanetriol, cyclohexanetriol, erythritol, pentaerythritol, diglycerin, sorbitol, mannitol, sucrose, triethanolamine, ethanolamine, ammonia, ethylenediamine, propanediamine, butanediamine, hexanediamine, diethyl toluenediamine, dimethyl-thio-toluenediamine, 4,4'-bis(2-chloroaniline), 4,4'-bis(sec-butylamino)-diphenylmethane, N,N'-dialkyl-diamino-diphenylmethane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylenebis(4-aminobenzoate), poly(tetramethylene oxide)-di-p-aminobenzoate, phenylenediamine, isophorone diamine, 4,4'-methylene bis(2-methylcyclohexane-1-amine), 4,4'-methylene bis(cyclohexane amine), bis(aminomethyl) cyclohexane, xylene diamine, iminobispropylamine, bis(hexanemethylene)triamine, triethylene tetramine, tetraethylene pentamine, pentaethylenehexamine, dipropylene triamine, aminoethylethanolamine, piperazine, tri(methylamino)hexane, melamine, a polycondensate of melamine and formaldehyde, polyethylene glycol mono(meta) acrylate, polyethylene glycol di(meta) acrylate, N-methylol(meta) acrylamide, glycidyl(meta) acrylate, N,N-methylene bis (meta) acrylamide, ethylene glycol diglycidyl ether, diethylene glycol diglycidyl ether, glycerin diglycidyl ether, glycerin triglycidyl ether, butanediol diglycidyl ether, hexanediol diglycidyl ether, cyclohexane dimethanol diglycidyl ether, trimethylolpropane diglycidyl ether, trimethylolpropane triglycidyl ether, polyethylene glycol polyglycidyl ether, and bis phenol A diglycidyl ether.

6. The papermaking felt according to claim 1, wherein a dry resin weight of the water-absorbing resin is from 0.5 to 30 wt. % relative to a total weight of the felt without the water-absorbing resin.

7. The papermaking felt according to claim 1, wherein the water-absorbing resin comprises at least one filler selected from the group consisting of titanium oxide, kaolin, clay, and talc.

8. A papermaking felt, comprising:

a base material; and a batt layer provided on one or both sides of the base material;

wherein:

the batt layer comprises a water-absorbing resin;

the water-absorbing resin has a coefficient of water absorption of from 1.05 to 10; and the water-absorbing resin is provided in the batt layer in the form of particles or in the form of a dispersed film.

9. The papermaking felt according to claim 8, wherein:

the water-absorbing resin is obtained by reacting at least one cross-linking agent (c) with a polyurethane, which comprises a urethane structure obtained by reacting at least one polyisocyanate compound (a) with at least one polyol compound (b);

the at least one polyisocyanate compound (a) comprises at least one member selected from the group consisting of 1,4-tetramethylene diisocyanate, 1,6-hexamethylene diisocyanate, 1,12-dodecamethylene diisocyanate, 1-isocyanate-3-isocyanatemethyl-3,5,5-trimethylcyclohexane (isophorone diisocyanate), bis-(4-isocyanatocyclohexane)methane (hydrogenerated MDI), 4,4'-methylene bis(phenyl isocyanate), tolylenediisocyanate, xylylene-diisocyanate, tetramethylxylylene-diisocyanate, 1,5-naphthalene diisocyanate, p-phenylene-diisocyanate, cyclohexane diisocyanate, 2,4-isocyanate cyclohexyl-2'-isocyanate cyclohexyl methane, bis-(isocyanate methyl)-cyclohexane, and bis-(4-isocyanate-3-methyl cyclohexyl)methane; and the at least one polyol compound (b) comprises at least one member selected from the group consisting of:

polyether polyols selected from polyethylene glycol, polypropylene glycol, polybutylene glycol, polypentylene glycol, polyhexylene glycol, glycerin, trimethylolethane, trimethylolpropane, hexanetriol, and pentaerythritol;

polyester polyols obtained by reacting at least one carboxylic acid with at least one polyol compound (d), wherein:

the at least one carboxylic acid comprises at least one member selected from the group consisting of oxalic acid, malonic acid, succinic acid, glutaric acid, adipic acid, azelaic acid, sebacic acid, phthalic acid, isophthalic acid, terephthalic acid, ricinoleic acid, and ϵ-caprolactone; and the at least one polyol compound (d) comprises at least one member selected from the group consisting of ethylene glycol, propanediol, butanediol, pentanediol, hexanediol, neopentyl glycol, diethylene glycol, 3-methyl-1,5-propanediol, glycerin, trimethylolethane, trimethylolpropane, hexanetriol, and pentaerythritol;

polycarbonate polyols selected from C6-homo-carbonate diol, C5/C6 copolymerized polycarbonate diol, C4/C6 copolymerized polycarbonate diol; and acrylic polyols.

10. The papermaking felt according to claim 9, wherein the at least one cross-linking agent (c) comprises at least one member selected from the group consisting of carboxylic acid sodium salts, carboxylic acid potassium salts, sulfonic acid sodium salts, sulfonic acid potassium salts, and quaternary halogenated ammonium salts.

11. The papermaking felt according to claim 8, wherein the water-absorbing resin comprises at least one component selected from the group consisting of:

compounds selected from chain or cyclic silicon compounds having at least one functional group as a side chain and/or terminal selected from hydrogen, alkyl groups, aryl groups, alkoxy groups, hydroxyl groups, polyether groups, polyglycerol groups, amino groups, epoxy groups, carboxyl groups, amide groups, methacrylate groups, mercapto groups, and N-alkylpyrrolidone groups;

compounds comprising a structure obtained by an addition reaction to starch of at least one compound selected from acrylonitrile, acrylic acid, acrylamide, methyl methacrylate, vinyl acetate, vinyl sulfonic acid, dimethylaminoethyl methacrylate, sodium monochloroacetate, sodium polyacrylate, epichlorohydrin, and styrene sulfonic acid;

compounds comprising a structure of a self-cross-linked starch;

compounds comprising a structure obtained by an addition reaction to carboxymethyl cellulose of at least one compound selected from acrylonitrile, sodium monochloroacetate, sodium polyacrylate, epichlorohydrin, and styrene sulfonic acid;

compounds comprising a structure of a self-cross-linked carboxymethyl cellulose;

compounds comprising a structure including hyaluronic acid and/or agarose cross-linked with boron and/or aluminum ions;

compounds comprising a structure of self-cross-linked hyaluronic acid and/or agarose;

compounds comprising a structure including acrylic acid and/or sodium polyacrylate graft-polymerized with polyvinyl alcohol;

compounds comprising a structure of self-cross-linked polyvinyl alcohol;

acrylic copolymer compounds copolymerized with at least one of acrylic acid, sodium acrylate, methyl methacrylate, acrylonitrile, vinyl alcohol, isopropylacrylamide, and methylene-bis-acrylamide;

compounds comprising a structure including acrylic acid and/or sodium acrylate graft-polymerized with polyurethane;

methylenebis-acrylamide copolymer compounds comprising copolymerized with at least one of methacrylic acid and isopropylacrylamide;

hydroxy methacrylate copolymer compounds copolymerized with at least one of ethylene glycol dimethacrylate and 2,3-dihydroxypropyl methacrylate; and nanocomposite hydrogels comprising at least one compound selected from a compound comprising a structure of self-cross-linked hydroxyl methacrylate copolymer compounds, isopropylacrylamide and dimethylacrylamide, adjusted with hectorite.

12. The papermaking felt according to claim 9, wherein the at least one cross-linking agent (c) comprises at least one member selected from the group consisting of ethylene glycol, propanediol, butanediol, pentanediol, hexanediol, polyethylene glycol, polypropylene glycol, polybutylene glycol, bisphenol A, trimethylolethane, trimethylolpropane, propanetriol (glycerin), butanetriol, pentanetriol, hexanetriol, cyclopentanetriol, cyclohexanetriol, erythritol, pentaerythritol, diglycerin, sorbitol, mannitol, sucrose, triethanolamine, ethanolamine, ammonia, ethylenediamine, propanediamine, butanediamine, hexanediamine, diethyl toluenediamine, dimethyl-thio-toluenediamine, 4,4'-bis(2-chloroaniline), 4,4'-bis(sec-butylamino)-diphenylmethane, N,N'-dialkyl-diamino-diphenylmethane, 4,4'-methylenedianiline, 4,4'-methylene-bis(2,3-dichloroaniline), 4,4'-methylene-bis(2-chloroaniline), 4,4'-methylene-bis(2-ethyl-6-methylaniline), trimethylenebis(4-aminobenzoate), poly(tetramethylene oxide)-di-p-aminobenzoate, phenylenediamine, isophorone diamine, 4,4'-methylene bis(2-methylcyclohexane-1-amine), 4,4'-methylene bis(cyclohexane amine), bis(aminomethyl) cyclohexane, xylene diamine, iminobispropylamine, bis(hexanemethylene)triamine, triethylene tetramine, tetraethylene pentamine, pentaethylenehexamine, dipropylene triamine, aminoethylethanolamine, piperazine, tri(methylamino)hexane, melamine, a polycondensate of melamine and formaldehyde, polyethylene glycol mono(meta) acrylate, polyethylene glycol di(meta) acrylate, N-methylol(meta) acrylamide, glycidyl(meta) acrylate, N,N-methylene bis (meta) acrylamide, ethylene glycol diglycidyl ether, diethylene glycol diglycidyl ether, glycerin diglycidyl ether, glycerin triglycidyl ether, butanediol diglycidyl ether, hexanediol diglycidyl ether, cyclohexane dimethanol diglycidyl ether, trimethylolpropane diglycidyl ether, trimethylolpropane triglycidyl ether, polyethylene glycol polyglycidyl ether, and bis phenol A diglycidyl ether.

13. The papermaking felt according to claim 8, wherein a dry resin weight of the water-absorbing resin is from 0.5 to 30 wt. % relative to a total weight of the felt without the water-absorbing resin.

14. The papermaking felt according to claim 8, wherein the water-absorbing resin comprises at least one filler selected from the group consisting of titanium oxide, kaolin, clay, and talc.

* * * * *

UNITED STATES PATENT AND TRADEMARK OFFICE

CERTIFICATE OF CORRECTION

PATENT NO. : 8,025,771 B2
APPLICATION NO. : 12/884552
DATED : September 27, 2011
INVENTOR(S) : Takashi Ouchi et al.

It is certified that error appears in the above-identified patent and that said Letters Patent is hereby corrected as shown below:

Column 4, line 11, "diisocyanate), bis-(4-isocyanatocyclohexane)methane(hy-" should read --diisocyanate), bis-(4-isocyanatecyclohexane)methane(hy- --;

Column 13, line 32, "hexane(isophorone diisoycanate), bis-(4-isocyanatocy-" should read --hexane(isophorone diisocyanate), bis-(4-isocyanatecy- --;

Signed and Sealed this
Third Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,025,771 B2
APPLICATION NO. : 12/884552
DATED : September 27, 2011
INVENTOR(S) : Takashi Ouchi et al.

It is certified that error appears in the above-identified patent and that said Letters Patent is hereby corrected as shown below:

On the title page, Item (75) Inventors: "Takashi Ouchi, Bunkyo-ku (JP);
Hiroyuki Oda, Bunkyo-ku (JP);
Hirofumi Murakami, Bunkyo-ku (JP);
Takao Yazaki, Bunkyo-ku (JP);
Yoshiaki Ito, Bunkyo-ku (JP);
Yuya Takamori, Bunkyo-ku (JP)"

should read -- Takashi Ouchi, Tokyo (JP);
Hiroyuki Oda, Tokyo (JP);
Hirofumi Murakami, Tokyo (JP);
Takao Yazaki, Tokyo (JP);
Yoshiaki Ito, Tokyo (JP);
Yuya Takamori, Tokyo (JP) --

Column 5, lines 52-55, "ene glycol (mono)meta acrylate, polyethylene glycol di(meta) acrylate, Nmethylol (meta) acrylamide, glycidyl(meta) acrylate, N,N-methylene bis (meta) acrylamide, ethyl-", should read -- ene glycol (mono)meth acrylate, polyethylene glycol di(meth) acrylate, Nmethylol (meth) acrylamide, glycidyl(meth) acrylate, N,N-methylene bis (meth) acrylamide, ethyl- --.

Column 13, line 33, "clohexane)methane (hydrogenerated MDI), 4,4'-meth-" should read -- clohexane)methane (hydrogenated MDI), 4,4'-meth- --.

Column 15, lines 22-25, "and formaldehyde, polyethylene glycol mono(meta) acrylate, polyethylene glycol di(meta) acrylate, N-methylol(meta) acrylamide, glycidyl(meta) acrylate, N,N-methylene bis (meta) acrylamide, ethylene glycol diglycidyl ether, diethyl-" should read -- and formaldehyde, polyethylene glycol mono(meth) acrylate, polyethylene glycol di(meth) acrylate, N-methylol(meth) acrylamide, glycidyl(meth) acrylate, N,N-methylene bis (meth) acrylamide, ethylene glycol diglycidyl ether, diethyl- --.

Signed and Sealed this
Fourteenth Day of August, 2012

David J. Kappos

David J. Kappos
*Director of the United States Patent and Trademark Office*

Column 15, line 62, “clohexane)methane (hydrogenerated MDI), 4,4’-meth-”, should read -- clohexane)methane (hydrogenated MDI), 4,4’-meth- --.

Column 18, lines 16-19, “and formaldehyde, polyethylene glycol mono(meta) acrylate, polyethylene glycol di(meta) acrylate, N-methylol(meta) acrylamide, glycidyl(meta) acrylate, N,N-methylene bis(meta) acrylamide, ethylene glycol diglycidyl ether, diethyl-”, should read -- and formaldehyde, polyethylene glycol mono(meth) acrylate, polyethylene glycol di(meth) acrylate, N-methylol(meth) acrylamide, glycidyl(meth) acrylate, N,N-methylene bis(meth) acrylamide, ethylene glycol diglycidyl ether, diethyl- --.